US011690443B1

(12) United States Patent
Couch

(10) Patent No.: US 11,690,443 B1
(45) Date of Patent: Jul. 4, 2023

(54) PAINTBRUSH SLEEVE

(71) Applicant: Robert L. Couch, Knoxville, TN (US)

(72) Inventor: Robert L. Couch, Knoxville, TN (US)

( * ) Notice: Subject to any disclaimer, the term of this patent is extended or adjusted under 35 U.S.C. 154(b) by 0 days.

(21) Appl. No.: 17/847,718

(22) Filed: Jun. 23, 2022

(51) Int. Cl.
*A46B 17/04* (2006.01)

(52) U.S. Cl.
CPC ..... *A46B 17/04* (2013.01); *A46B 2200/202* (2013.01)

(58) Field of Classification Search
CPC ..... A46B 17/04
USPC ..... 15/247
See application file for complete search history.

(56) References Cited

U.S. PATENT DOCUMENTS 5,709,301 A * 1/1998 Couch ..... B44D 3/125 220/804
2004/0250840 A1* 12/2004 Baker ..... A46B 17/04 15/247

OTHER PUBLICATIONS

Screen captures from YouTube video clip entitled "How To Protect a Brush Between Coats of Paint," 1 page, uploaded on Jul. 15, 2010 by user "finehomebuilding". Retrieved from Internet: <https://www.youtube.com/watch?v=eL1x6W0QdUs>. (Year: 2010).*

* cited by examiner

*Primary Examiner* — Anne M Kozak
*Assistant Examiner* — Aaron R McConnell
(74) *Attorney, Agent, or Firm* — Pitts & Lake, P.C.

(57) ABSTRACT

A paintbrush sleeve, and a method of using the paintbrush sleeve, to keep bristles of a paintbrush moist, including a sleeve member configured to retain moisture, wherein the sleeve member is configured to snugly fit at least partially over the bristles of the paintbrush.

4 Claims, 3 Drawing Sheets

PAINTBRUSH SLEEVE

CROSS-REFERENCE TO RELATED APPLICATIONS

Not applicable.

FIELD OF INVENTION

The present general inventive concept relates to paintbrush maintenance, and, more particularly, to a paintbrush sleeve to keep paintbrush bristles moist.

BACKGROUND

Painting can be difficult and time-consuming work, and is made ever more difficult and time-consuming due to cleaning paintbrushes one or more times before a painting job is complete. For example, if a painter is taking a lunch break, or breaking for the day before a job is complete, the painter may typically clean the paintbrush being used so that the wet paint on the brush does not dry. Therefore, not only is it time-consuming to clean the brush each time this happens, but it is also not friendly to the environment to keep sending the paint cleaned off of the brush to any of the various places that such pain eventually ends up. Another problem is that the upper part of the bristles of the paintbrush do not move or get resupplied with paint like the distal ends of the bristles are, and thus the upper part tends to dry out even during the active portion of the paint job. Thus, it would be desirable to have a system to be able to store the brush at least temporarily while it is still wet with paint, and to keep the upper bristles moist during the painting process.

BRIEF SUMMARY

According to various example embodiments of the present general inventive concept, a paintbrush sleeve, and a method of using the paintbrush sleeve, is provided to prevent at least a heel of the bristles, or portion of the bristles adjacent the heel, of the paintbrush from drying out during and/or in between painting operations.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by providing a paintbrush sleeve to keep bristles of a paintbrush moist, including a sleeve member configured to retain moisture, wherein the sleeve member is configured to snugly fit at least partially over the bristles of the paintbrush.

The foregoing and/or other aspects and advantages of the present general inventive concept may also be achieved by providing a method of caring for a paintbrush, the method including providing a sleeve member configured to fit snugly over at least a portion of bristles of the paintbrush, placing the sleeve member over at least the portion of the bristles, and moistening the sleeve member so as to prevent at least the portion of the bristles surrounded by the sleeve member from drying out.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Figure 1:
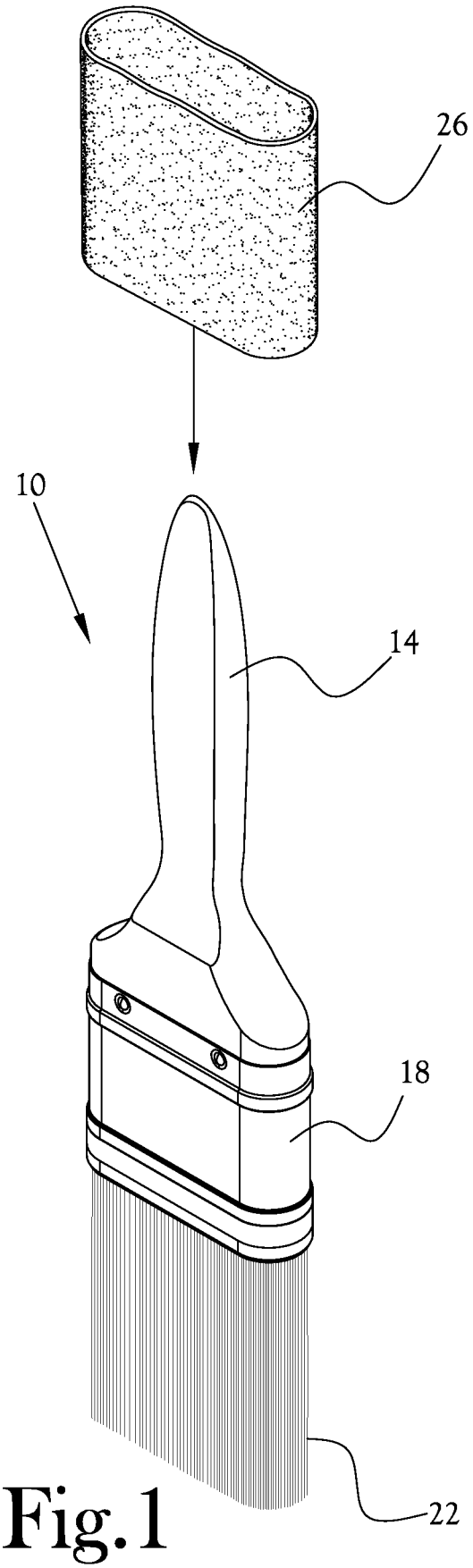
FIGS. 1-2 illustrate a paintbrush sleeve and method of use according to an example embodiment of the present general inventive concept.

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Paintbrushes are typically constructed with three main parts, being the handle, the ferrule, and the bristles. When painting, the distal end or tip of the brush is active in spreading the paint, while the upper part of the bristles, sometimes referred to as the heel, is mostly inactive. The upper part of the bristles retain paint that is prone to drying out during a painting operation, due to the relative non-movement when compared to the tips of the bristles, which are often moving during strokes of the brush, and being resupplied with fresh paint. The upper portion of the bristles proximate the ferrule are bound tightly, and as such do not move like the lower part of the bristles. Thus, the drying of the paint on the upper portion of the bristles often causes the user to have to scrub the bristles with a wire brush or the like to clean the brush after a painting operation. Often the brushes, which can cost upwards of $20 or more each, are simply ruined when the heel of the brush, or portions of the bristles adjacent the heel, hardens from the drying paints.

Various example embodiments of the present general inventive concept provide a paintbrush skirt or sleeve that may be made of a soft absorbent fabric, or foam, or the like, the fits snugly on the paint brush to a point (approximately one and a half to two inches in some example embodiments) just short of the tip. The skirt or sleeve provides protection for the heel of the bristles, preventing the drying of the paint on the upper portion of the bristles during the painting operation, and during periods between painting operations in some embodiments. The sleeve can be wet before or after being applied to the brush, and occasionally wetting the sleeve during a painting operation can also help prevent paint from drying in the heel. Example embodiments may be made of a soft absorbent cotton, or a foam, that retains water or other moisture, and may fit up part of the paintbrush handle like a skirt. As paintbrushes are becoming more and more expensive it is important to take better care of the brushes, and the sleeves according to example embodiments of the present general inventive concept are a novel and beneficial way of taking such care. The sleeves may be configured to be hand-washed, which may include being submerged in water or other liquids.

Figure 2:
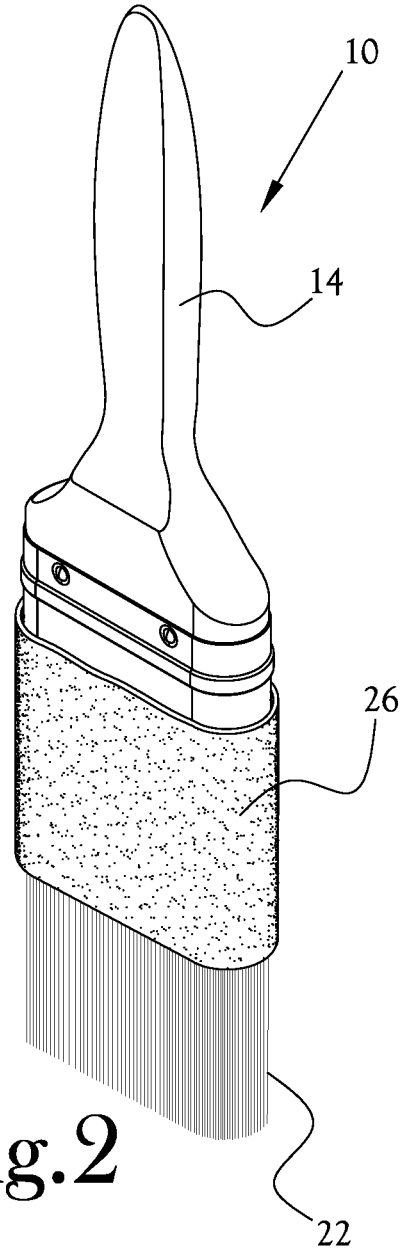

According to various example embodiments of the present general inventive concept, a paintbrush sleeve is provided to fit snuggle over a portion of the paintbrush and to retain moisture so as to keep at least a portion of the bristles of the paintbrush moist during or between painting operations. FIGS. 1-2 illustrate a paintbrush sleeve and method of use according to an example embodiment of the present general inventive concept. As illustrated in FIGS. 1-2, a paintbrush 10 includes a handle portion 14, a ferrule 18, and bristles 22. While the paintbrushes described herein typically include such a ferrule, it is understood that various example embodiments of the present general inventive concept may be applied to paintbrushes having a base portion, instead of a ferrule, between the handle and bristles without departing from the scope of the present general inventive concept. As illustrated, a moisture retaining sleeve member 26 is configured to be passed over the paintbrush to cover at least a portion of the bristles 22 near the ferrule 18. The sleeve member 26 may be moistened before or after being placed on the paintbrush 10, and may be remoistened while on the paintbrush 10. In this example embodiment the sleeve member 26 extends over at least a portion of the ferrule 18 to help maintain the grip over the desired portion of the paintbrush 10, but in various example embodiments the sleeve 26 may fit only over the bristles 22. The sleeve 26 is selectively placed to expose a desired portion of the distal end of the bristles 22, and keeps the bristles 22 under the sleeve 26 moist by retaining water or other liquid in the sleeve 26. The sleeve may be a moisture absorbent cloth, or foam, or the like, or any combination thereof.

Figure 3A:
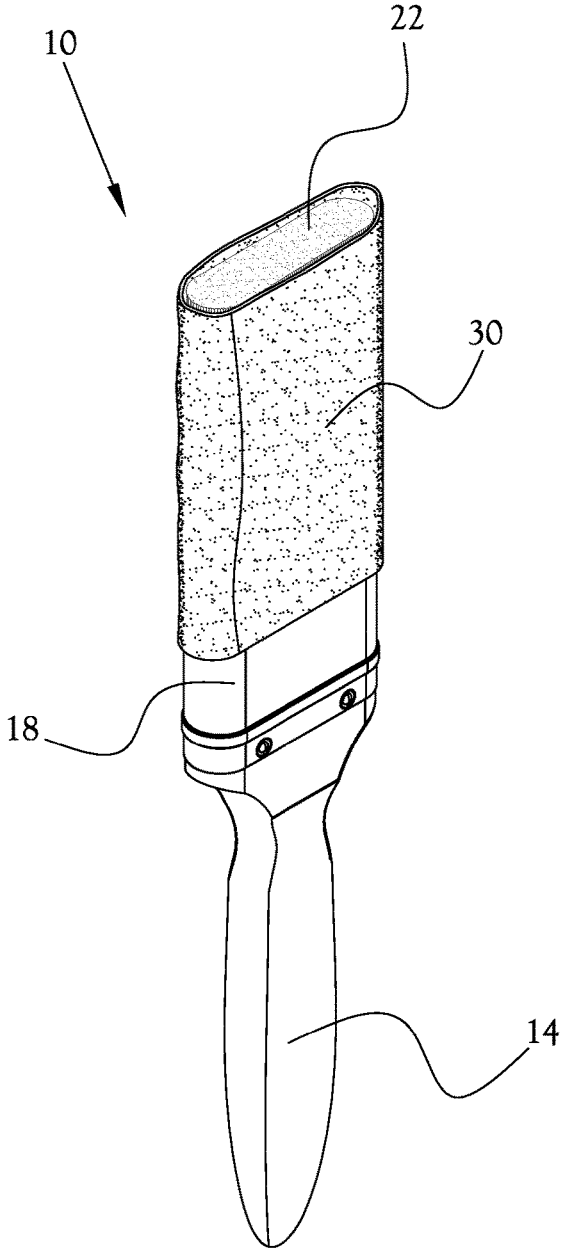
FIGS. 3A-B illustrate a paintbrush sleeve and method of use according to another example embodiment of the present general inventive concept.
Figure 3B:
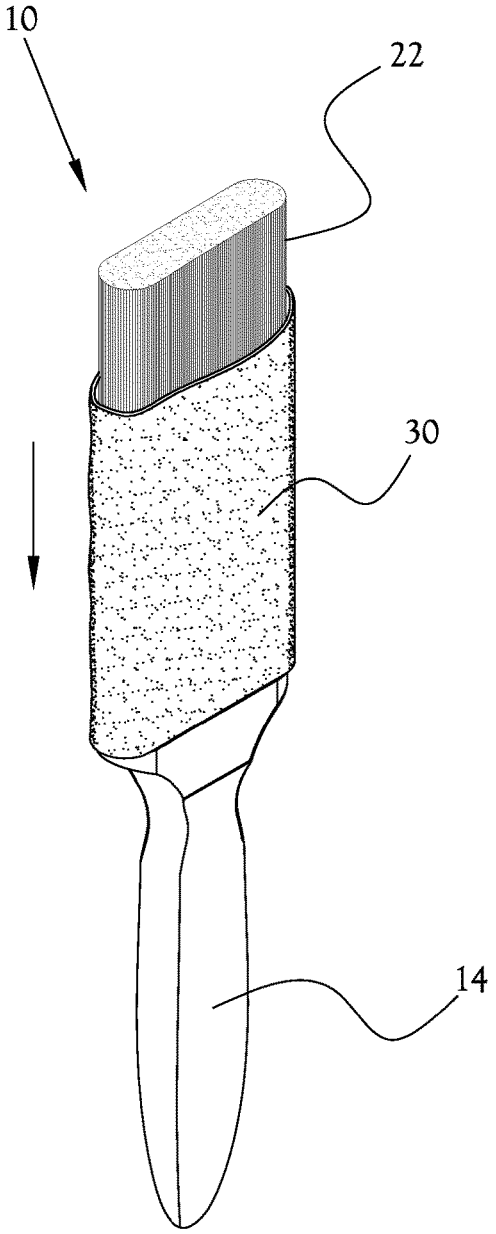

FIGS. 3A-B illustrate a paintbrush sleeve and method of use according to another example embodiment of the present general inventive concept. In the example embodiment illustrated in FIGS. 3A-B, a sleeve member 30 is configured with a length sufficient to selectively cover the entirety of the bristles 22. Thus, during breaks between painting operations, the moisture retaining sleeve 30 can be slid down to keep the entirety of the bristles moist or wet, and can be simply slide upward further over the brush 10 to expose the desired length of the tip of the bristles 22 to continue the painting operation. The sleeve 30 may be configured with a length so as to not reach further than the ferrule 18 in the direction of the handle 14, so as to keep from making the handle 14 moist. In various example embodiments a sleeve similar to the sleeve 30 of FIGS. 3A-B may be formed with a closed end to keep even the very tips of the bristles moist for longer breaks in the painting operation, and may be removed from the brush to continue painting. While the sleeve member 30 of this example embodiment is configured to not extend past the ferrule 18 when moved up to continue the painting operation, in various example embodiments the sleeve member may extend further in the direction of the handle.

Figure 4:
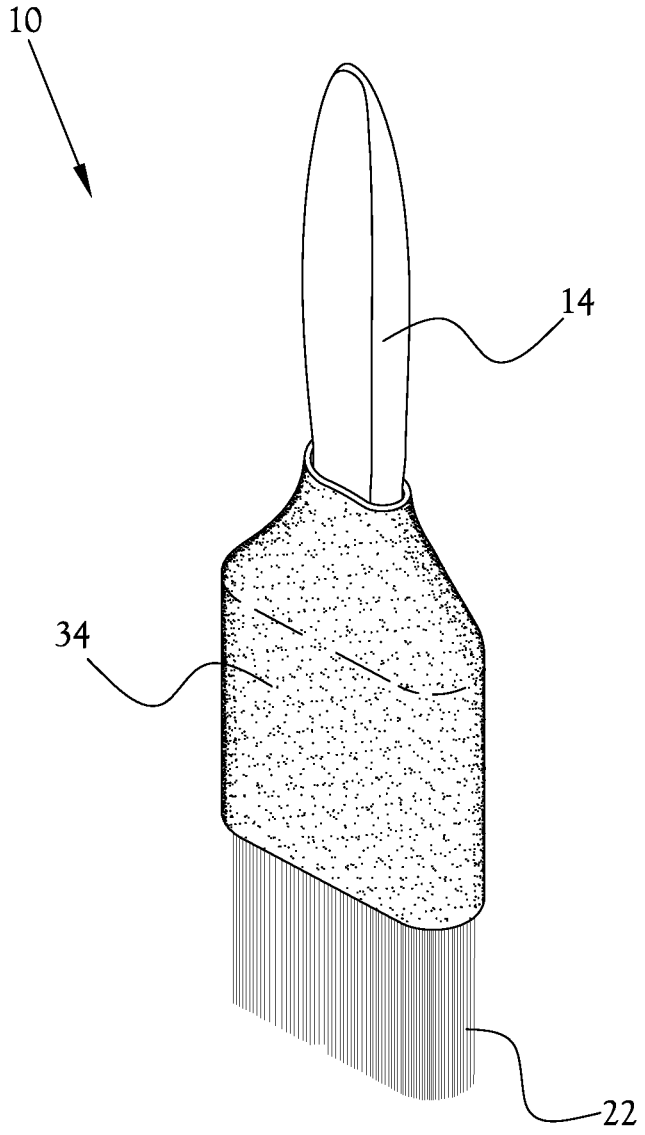
FIG. 4 illustrates a paintbrush sleeve according to still another example embodiment of the present general inventive concept.

FIG. 4 illustrates a paintbrush sleeve according to still another example embodiment of the present general inventive concept. In the example embodiment illustrated in FIG. 4, a sleeve member 34 is configured with a tapered upper portion that fits snugly over at least a portion of the handle 14 of the paint brush 10, which may provide a more secure fit to prevent any unwanted sliding of the sleeve 34 relative to the paintbrush 10 during a painting operation.

Various example embodiments of the present general inventive concept may provide a paintbrush sleeve to keep bristles of a paintbrush moist, including a sleeve member configured to retain moisture, wherein the sleeve member is configured to snugly fit at least partially over the bristles of the paintbrush. The sleeve member may be configured to snugly fit at least partially over the bristles and at least partially over a ferrule of the paintbrush. The sleeve member may be configured to be selectively moved to cover an entirety of the bristles of the paintbrush. The sleeve member may be configured to expose approximately two inches of the bristles at a distal end of the bristles. The sleeve member may be configured with a tapered upper portion configured to fit over a portion of a handle of the paintbrush. The sleeve member may include a foam material configured to retain moisture. The sleeve member may include a cloth material configured to retain moisture. The sleeve member may be configured to fit over the bristles sufficiently snugly so as to prevent sliding over the bristles when not moved by a user of the paintbrush.

Various example embodiments of the present general inventive concept may provide a method of caring for a paintbrush, the method including providing a sleeve member configured to fit snugly over at least a portion of bristles of the paintbrush, placing the sleeve member over at least the portion of the bristles, and moistening the sleeve member so as to prevent at least the portion of the bristles surrounded by the sleeve member from drying out. The sleeve member may be moistened before or after being placed on the paintbrush. The method may further include remoistening the sleeve member after an interval of time has passed. The sleeve member may be configured to cover an entirety of a length of the bristles. The method may further include sliding the sleeve member to completely cover the length of the bristles to keep the bristles moist between painting operations.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. A method of caring for a paintbrush, the method comprising:

providing a sleeve member configured to fit snugly over at least a portion of bristles of the paintbrush, wherein the sleeve member is made of absorbent material and has two opposing openings;

placing the sleeve member over at least the portion of the bristles; and moistening the sleeve member after the sleeve member has been placed on the paintbrush so as to prevent at least the portion of the bristles surrounded by the sleeve member from drying out.

2. The method of claim 1, further comprising remoistening the sleeve member after an interval of time has passed.

3. The method of claim 1, wherein the sleeve member is configured to cover an entirety of a length of the bristles.

4. The method of claim 3, further comprising sliding the sleeve member to completely cover the length of the bristles to keep the bristles moist between painting operations.

* * * * *